US007111920B2

(12) United States Patent
Lee et al.

(10) Patent No.: US 7,111,920 B2
(45) Date of Patent: Sep. 26, 2006

(54) FLUID JET HEAD WITH DRIVING CIRCUIT OF A HEATER SET

(75) Inventors: Kun-Ming Lee, Taipei (TW); Tsung-Wei Huang, Taipei (TW)

(73) Assignee: Benq Corporation, Taoyuan Shien (TW)

( * ) Notice: Subject to any disclaimer, the term of this patent is extended or adjusted under 35 U.S.C. 154(b) by 81 days.

(21) Appl. No.: 11/063,283

(22) Filed: Feb. 22, 2005

(65) Prior Publication Data

US 2005/0200297 A1 Sep. 15, 2005

(30) Foreign Application Priority Data

Mar. 9, 2004 (TW) ..... 93106266 A

(51) Int. Cl.
*B41J 2/015* (2006.01)

(52) U.S. Cl. ..... 347/20; 347/21; 347/26; 347/57; 347/65

(58) Field of Classification Search ..... 347/7, 347/9–11, 14, 17, 20, 21, 26, 48, 54, 57, 65
See application file for complete search history.

(56) References Cited

U.S. PATENT DOCUMENTS 5,563,634 A * 10/1996 Fujii et al. ..... 347/9
5,604,519 A * 2/1997 Keefe et al. ..... 347/13
5,734,391 A * 3/1998 Tanaka et al. ..... 347/14
6,412,917 B1 * 7/2002 Torgerson et al. ..... 347/55

* cited by examiner

*Primary Examiner*—Haissa Philogene
(74) *Attorney, Agent, or Firm*—Thomas, Kayden, Horstemeyer & Risley

(57) ABSTRACT

A fluid jet head with driving circuit of a heater set. A first and a second primary transistor are coupled to a first and a second heater. When the first primary transistor is turned on under control of a first control voltage and a first current is generated flowing through the first heater, the first primary transistor, and the first current path, then the first primary transistor has a first primary equivalent resistance corresponding to the first control voltage. When the second primary transistor is turned on under control of a second control voltage, and a second current is generated flowing through the second heater, the second primary transistor, and a second current path, then the second primary transistor has a second primary equivalent resistance corresponding to the second control voltage. Therefore, the thermal energy generated by the first heater is substantially equal to that generated by the second heater.

19 Claims, 8 Drawing Sheets

FLUID JET HEAD WITH DRIVING CIRCUIT OF A HEATER SET

This application claims the benefit of Taiwan application Serial No. 093106266, filed Mar. 9, 2004, the subject matter of which is incorporated herein by reference.

BACKGROUND OF THE INVENTION

1. Field of the Invention

The invention relates in general to fluid jet heads, and more particularly to fluid jet heads with driving circuit of a heater.

2. Description of the Related Art

Technological advancements have led to the wide use of fluid jet heads in application of inkjet heads of inkjet printers. Thermal driver bubbles, especially, are a commonly adapted method in inkjet head design for ejecting ink droplets. The reason for the wide use of inkjets using such method can be accredited to the simplicity in design, low production costs, and ability to separately output uniformly sized ink droplets.

FIG. 1 shows a bubble jet head having discharging mechanism according to U.S. Pat. No. 5,604,519, which includes a heater 102, a MOSFET 104, and a pull-down resistor 106. Heater 102 is electrically connected to the drain of MOSFET 104, and pull down resistor 105 is electrically connected to the gate of MOSFET 104. When MOSFET 104 goes from an on to an off state, the remaining charge left on the gate is discharged via resistor 106 to ground in specified periods. Thus, the error situations resulting from the continuing ejection of ink droplets from the corresponding nozzles in case of MOSFET turning off too late can be prevented.

However, in one embodiment of the U.S. Pat. No. 5,604,519, pull-down resistor 106 is a snake-shaped resistor formed by conducting materials. Between the snake-shaped resistor and the substrate, there exists a $SiO_2$ insulation layer. Since pull-down resistor 106 does not come in direct contact with the substrate, which has a thermoconductivity of 160 W/mk, but rather forms direct contact with the $SiO_2$ of thermoconductivity 1.4 W/mK. Thus, the disadvantage of the pull down resistor is that it is not very efficient in heat dissipation. Also, another disadvantage of inkjet head disclosed by U.S. Pat. No. 5,604,519 is that, due to the size of the snake-shaped resistor, large chip areas are needed to accommodate the size.

FIG. 2 shows a diagram of an inkjet head capable of producing same heat energy from every heater. Since each heater is positioned different in location, the length of the trace connecting to the two ends of every heater 56 is different. The parasitic resistance on the two ends of every heater 56 is thus different. This difference in parasitic resistance in turn causes the current flowing thought heater 56 to be different, and as a result, the heat energy produced by heater 56 is also different. Consequently, under U.S. Pat. No. 6,412,917, the parasitic resistance on two ends of each heater 56 is compensated through adjusting the channel width of MOSFET 85 cascaded under heater 56 (and thereby adjusting the channel resistance). However, the disadvantage of U.S. Pat. No. 6,412,917 is that the inkjet head is not equipped with the capability to discharge the charge remaining on the gate of the MOSFET Thus, being able to design a fluid jet capable of effectively discharging the charge remaining in the gates of transistors to ground quickly in order to increase the fluid jet head operation speed, while compensating the parasitic resistances associated with the two ends of every heater is one of the goals that the industry has been trying hard to achieve.

SUMMARY OF THE INVENTION

It is therefore an object of the invention to provide a fluid jet head with driving circuit of a heater that is capable of effectively discharging the charge remaining in the gate of the transistor to ground, thereby increasing the operation speed of the fluid jet head, and is also capable of compensating the parasitic resistances on the two ends of every heater.

The invention achieves one of the above-identified object by providing a circuit for driving a heater set. The heater set includes a first heater and a second heater. The circuit includes a number of current paths, a bias-voltage-selecting unit, a first primary transistor, and a second primary transistor. Each heater of the heater set is electrically connected to one of the corresponding current paths. The current paths include a first current path and a second current path. Bias-voltage-selecting unit is for outputting a first control voltage and a second control voltage. First primary transistor is electrically connected to the first heater. The primary transistor has a first primary transistor equivalent resistance when the first primary transistor is turned on under the control of the first control voltage, and when a first current is generated and flows through a first heater, a first primary transistor, and a first current path. Similarly, a second primary transistor is electrically connected to the second heater. The second primary transistor has a second primary transistor equivalent resistance when the second primary transistor is turned on under the control of the second control voltage, and when a second current is generated and flows through the second heater, the second primary transistor, and a second current path. The first primary transistor equivalent resistance and the second primary transistor equivalent resistance respectively correspond to the first control voltage and the second control voltage, thereby causing the thermal energy generated by the first and second heater to substantially equal to each other.

The invention achieves another above-identified object by providing a fluid jet head. The fluid jet head includes a heater set and a driving circuit. The heater set is arranged in a matrix of M rows by N columns, where the heater of the $i^{th}$ row and the $j^{th}$ column is heater (i, j), the heater of the $i^{th}$ row and the $k^{th}$ column is heater (i, k), wherein M, N, i, j, k are whole numbers, i is less than M, j is less than N, and j does not equal to k. The driver circuit includes a number of current paths, a bias-voltage-selecting unit, and M×N number of primary transistors. Each of the heaters is electrically connected to one of the corresponding current paths, where the current paths includes a current path (i, j) and a current path (i, k). The bias-voltage-selecting unit is for outputting N control voltages, including a $j^{th}$ control voltage and a $k^{th}$ control voltage. And M×N number of primary transistors includes a primary transistor (i, j) that is electrically connected to heater (i, j). The resistance of the primary transistor (i, j) is equivalent to a primary transistor equivalent resistance (i, j) when the primary transistor (i, j) is turned on under the control of the $j^{th}$ control voltage, and when a current (i, j) is generated and flows through the heater (i, j), the primary transistor (i, j) and the current path (i, j). In the similar fashion, primary transistor (i, k) is electrically connected to heater (i, k). The resistance of the primary transistor (i, k) is equivalent to a primary transistor equivalent resistance (i, k) when primary transistor (i, k) is turned on under the control of the $k^{th}$ control voltage, and when a current (i, k) is generated and flows through the heater (i, k), the primary transistor (i, k), and the current path (i, k). The primary transistor equivalent resistance (i, j) and the primary transistor equivalent resistance (i, k) respectively correspond to the $j^{th}$ control voltage and the $k^{th}$ control voltage, thereby causing the thermal energy generated by the heater (i, k) and heater (i, k) to substantially equal each other.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 3A:
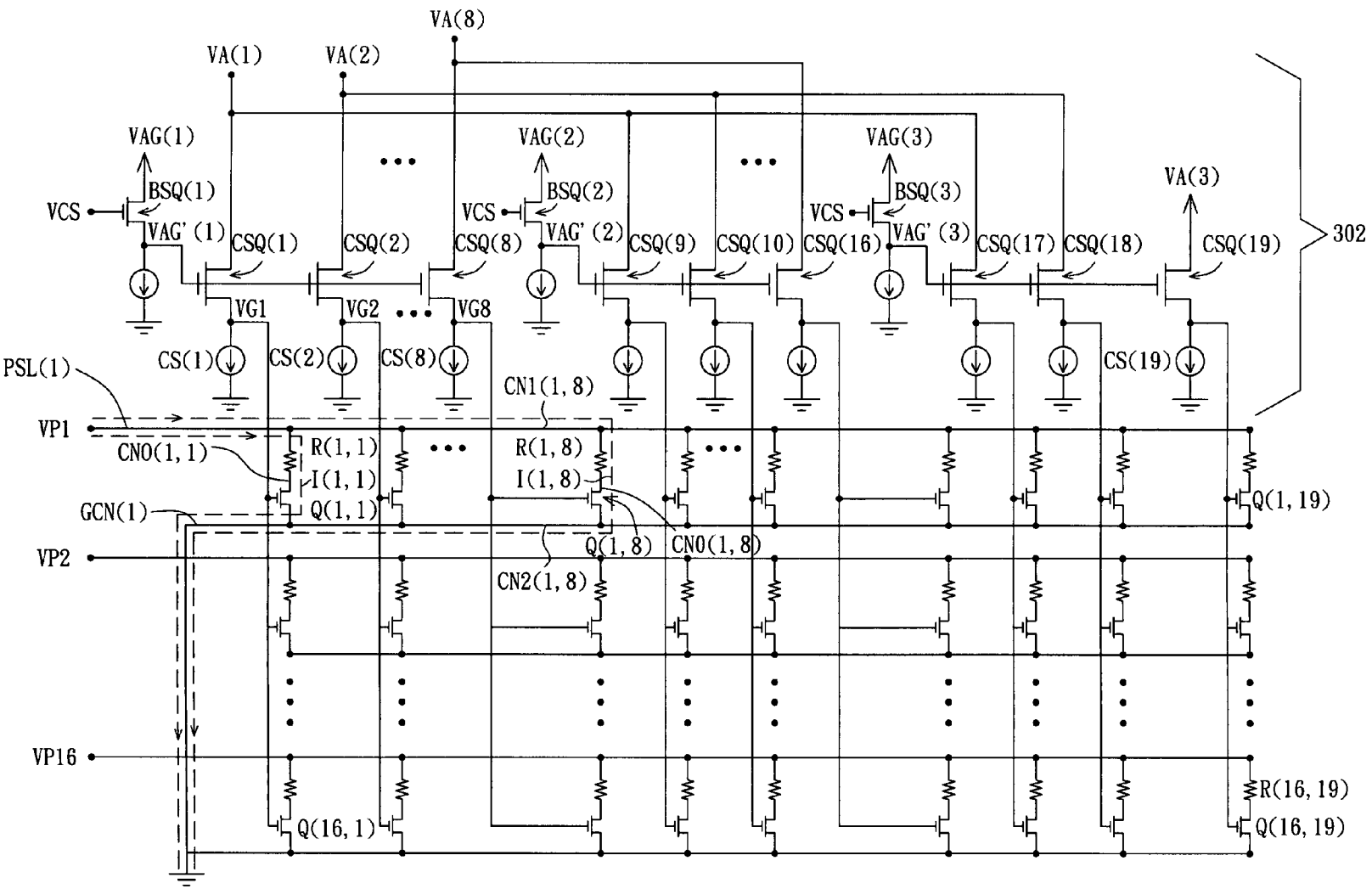
FIG. 3A shows a circuit diagram illustrating a fluid jet head with driving circuit of a heater according to a preferred embodiment of the invention.
Figure 3B:
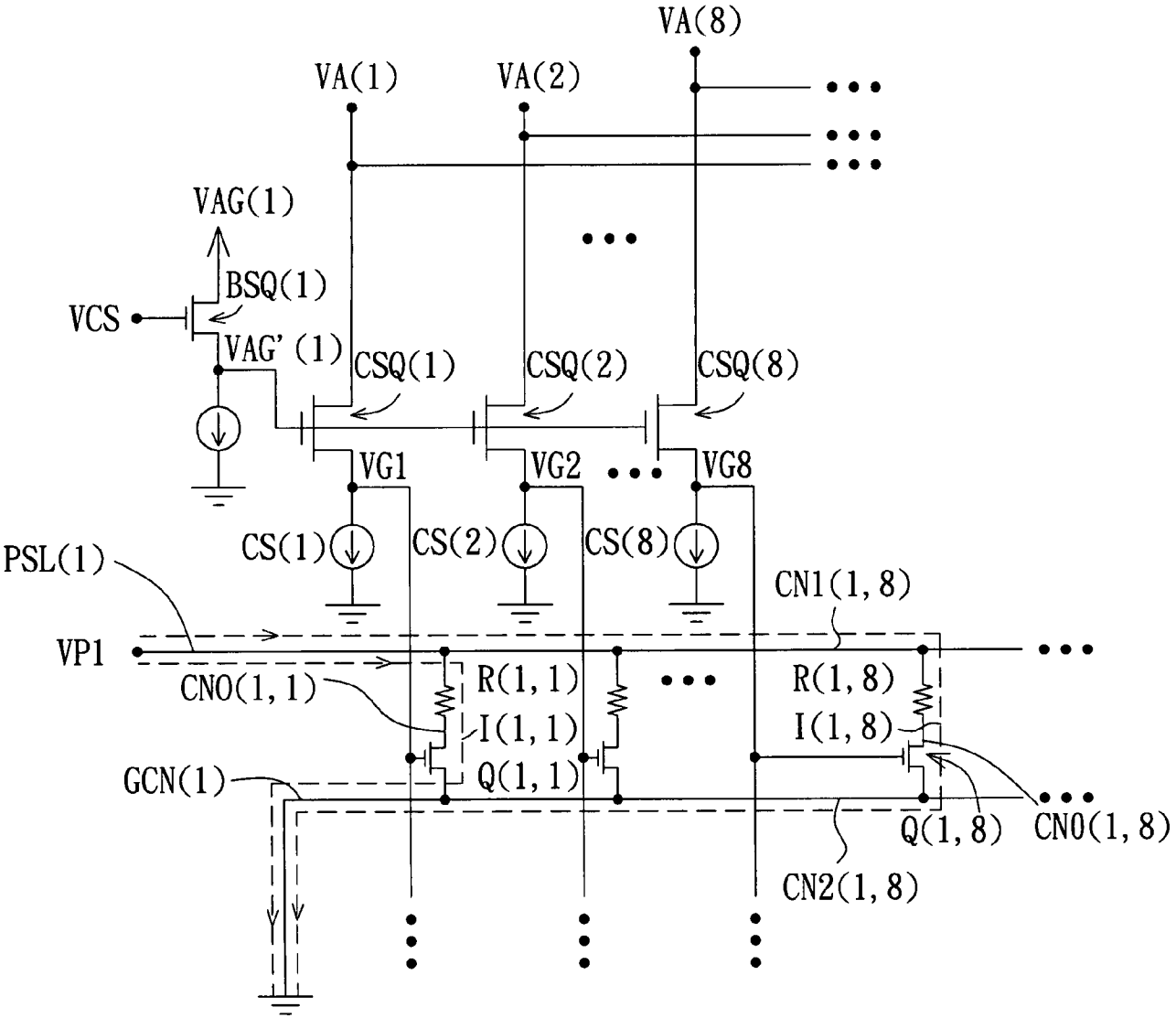
FIG. 3B is an enlarged view of part of FIG. 3A.

FIG. 3A shows a circuit for driving a heater set of a fluid jet head according to a preferred embodiment of the invention, and FIG. 3B shows an enlarged view of a part of FIG. 3A. The fluid jet head of the invention includes a heater set and a driving circuit. The heater set has a M×N heaters R that are arranged in a M×N matrix. The heater of the $i^{th}$ row and the $j^{th}$ column is heater R(i, j), the heater of the $i^{th}$ row and the $k^{th}$ column is heater R(i, k), wherein M, N, i, j, k are whole numbers, i is less than or equal to M, j is less than or equal to N, and j does not equal to k.

The driver circuit includes current paths, a bias-voltage-selecting unit 302, and M×N primary transistor Q. Each of the heaters is electrically connected to the corresponding current path. The current path includes a current path (i, j) and a current path (i, k). Bias-voltage-selecting unit 302 outputs N control voltages, including a $j^{th}$ control voltage VG(j) and a $k^{th}$ control voltage VG(k). M×N primary transistors Q includes a primary transistor Q(i, j) and Q(i, k). The primary transistor Q(i, k) is electrically connected to the heater R(i, j). The resistance of the primary transistor Q(i, j) is equivalent to a primary transistor equivalent resistance (i, j) when the primary transistor Q(i, j) is turned on under the control of the $j^{th}$ control voltage VG(j), and when a current (i, j) is generated and flows through the heater R(i, j), the primary transistor Q(i, j) and the current path (i, j). Primary transistor Q(i, k) is electrically connected to the heater R(i, k). The resistance of the primary transistor Q(i, k) is equivalent to a primary transistor equivalent resistance (i, k) when the primary transistor Q(i, k) is turned on under the control of the $k^{th}$ control voltage VG(k), and when a current (i, k) is generated and flows through the heater R(i, k), the primary transistor Q(i, k), and the current path (i, k). The primary transistor equivalent resistance (i, j) and the primary transistor equivalent resistance (i, k) respectively correspond to the $j^{th}$ control voltage VG(j) and the $k^{th}$ control voltage VG(k), thereby causing the thermal energy generated by the heater R(i, k) and heater R(i, k) to substantially equal each other.

Figure 4:
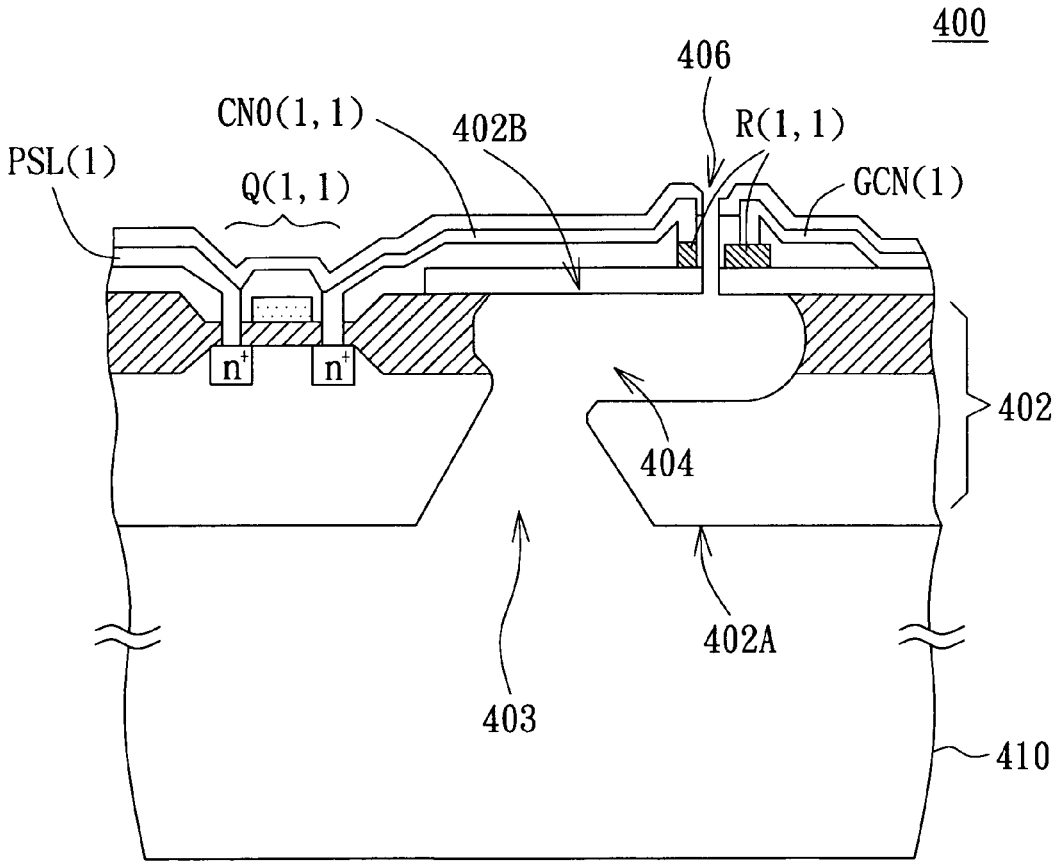
FIG. 4 is side view illustrating a part of the fluid jet head according to an embodiment of the invention.
Figure 5:
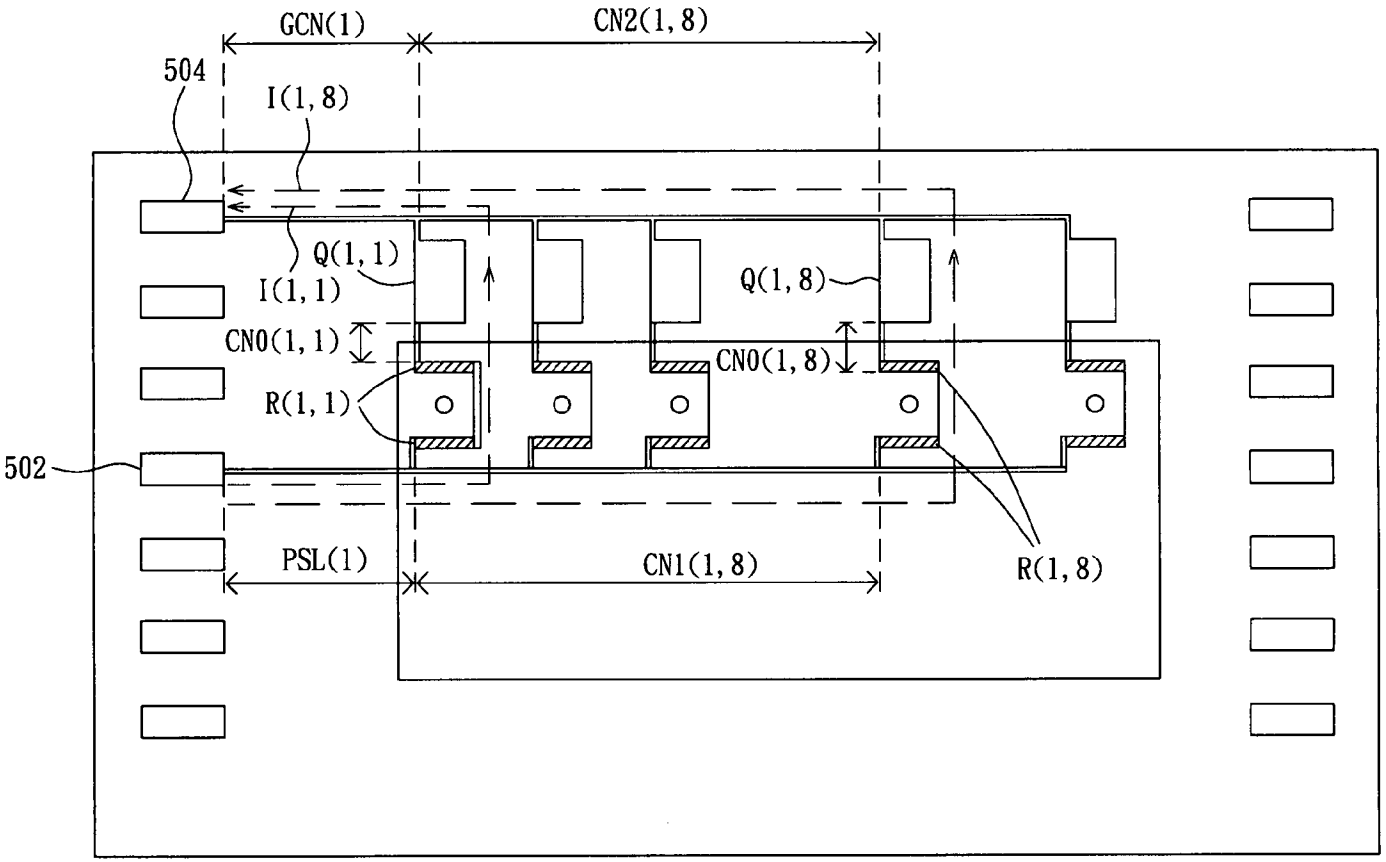
FIG. 5 shows a top view illustrating a part of the fluid jet head according to an embodiment of the invention.

In the following example, it is supposed that M=16, N=19, l=1, j=1, and k=8 to facilitate the understanding of the invention. Please refer to both FIG. 4 and FIG. 5. FIG. 4 is a side view illustrating a part of the fluid jet head according to an embodiment of the invention. FIG. 5 shows a top view illustrating a part of the fluid jet head according to an embodiment of the invention. As shown in FIG. 4, the fluid jet head 400 of the invention includes substrate 402. Substrate 402 has M×N manifolds, M×N chambers, an M×n orifices. FIG. 4 particularly illustrates manifold 403, chamber 404, orifice 406, and heater R(1,1) that are corresponding to primary transistor Q(1,1). One end of manifold 403 forms on a bottom surface 402A of the substrate 402. Chamber 404 is disposed above the corresponding manifold 403, and is also connected with the corresponding manifold 403. Chamber 404 is for containing a fluid. All the orifices are arranged in an M×N matrix. Orifice 406 is disposed above the corresponding chamber 404, and one end of orifice 406 forms on a top surface 402B of the substrate 402. Heater R(1, 1) is disposed on the side of the corresponding orifice 406. When heater R(1, 1) generates thermal energy, the corresponding orifice 406 outputs an air bubble, thereby allowing the fluid of the corresponding chamber 404 to be jetted out.

The fluid jet head 400 is preferably the ink jet head of an inkjet printer. Fluid jet head 400 further includes an ink cartridge 410. Manifold 403 is connected to ink cartridge 410, and the fluid mentioned above is preferably an ink fluid.

In addition, fluid jet head 400 further comprises a number of conducting lines CN0 Conducting lines CN0 are being disposed on the top surface above the manifold. Conducting line CN0(1, 1) is for electrically connecting the corresponding heater R(1, 1) to primary transistor Q(1,1). The material of the conducting line is selected from the group consisting of Aluminum, Gold, Copper, Tungsten, Aluminum-Silicon-Copper e Alloy, and Copper-Aluminum Alloy, or the combination thereof.

Referring to both FIG. 3 and FIG. 5, the primary transistors are supposed to be NMOS transistors for the sake of illustration. Drain of primary transistor Q(1, 1) is electrically connected to one end of heater R(1, 1), and source of primary transistor Q(1, 1) is grounded. Another end of heater R(1, 1) is connected to primary select line PSL (1). When bias-voltage-selecting unit 302 outputs a high signal level voltage, being a $1^{st}$ control voltage VG(1), to gate of primary transistor Q(1, 1), then primary transistor Q(1, 1) is turned on. At this time, if primary select signal VP(1) input from addressing pad 502 to the primary select line PSL(1) is enabled, such as when control voltage VP(1) signal turns high, current I(1, 1) is generated, and flows through heater R(1, 1), drain and source of primary transistor Q(1, 1), and current path (1, 1). The current path (1, 1) is the group consisting of other trace or conductor except heater R(1, 1) and primary transistor Q(1, 1) which current I(1, 1) flows through when current I(1, 1) is generated. For example, current path (1, 1) is formed by the primary select line PSL(1), the conducting line CN0(1,1) between heater R(1,1) and primary transistor Q(1,1), and the conducting line GCN(1) between source of primary transistor Q(1, 1) and ground 504. At this time, the resistance of primary transistor Q(1, 1) is equivalent to a primary transistor equivalent resistance (1, 1).

Likewise, drain of primary transistor Q(1, 8) is electrically connected to one end of heater R(1, 8), and source of primary transistor Q(1, 8) is grounded. Another end of heater R(1, 8) is connected to primary select line PSL (1). When bias-voltage-selecting unit 302 outputs a high signal level voltage, being an $8^{th}$ control voltage VG(8), to gate of primary transistor Q(1, 8), then primary transistor Q(1, 8) is turned on. At this time, if primary select signal VP(1) input from addressing electrode 502 to primary select line PSL(1) is enabled, current I(1, 8) is generated, and flows through heater R(1, 8), drain and source of primary transistor Q(1, 8), and current path (1, 8). The current path (1, 8) is the group consisting of other trace or conductor except heater R(1, 8) and primary transistor Q(1, 8) which current I(1, 8) flows through when current I(1, 8) is generated. For example, current path (1, 8) is formed by the primary select line PSL(1), the conducting line CN1(1,8) between heater R(1,1) and heater R(1,8), the conducting line CN0(1, 8) between heater R(1, 8) and primary transistor Q(1, 8), conducting line CN2 (1, 8) between source of primary transistor Q(1, 1) and source of primary transistor Q(1, 8), and the conducting line GCN(1) between source of primary transistor Q(1, 1) and ground 504. At this time, the resistance of primary transistor Q(1, 8) is equivalent to a primary transistor equivalent resistance (1, 8).

As shown in FIG. 3, primary transistors Q(1, 1) and Q(1, 8) are positioned in different locations. Thus, the corresponding current paths of the two transistors also have different lengths. Comparing to current path (1, 1), current path (1, 8) has extra conducting lines CN1(1, 8) and CN2 (1,8). As a result, current path (1, 8) is longer than current path (1, 1). Therefore, compared to current path (1, 1), current path (1, 8) has a greater equivalent resistance. If equivalent resistances (1, 1) and (1, 8) of primary transistors Q(1, 1) and Q(1, 8) are equal, and equivalent resistances of heater R(1, 1) and heater R(1, 8) are equal, then current 1(1, 1) will be greater than current I(1, 8), and thereby causing thermal energy generated by heater R(1, 1) to be greater than that of heater R(1, 8); thus, an orifice heated by heater R(1, 1) will eject ink droplets that are larger than the ones ejected by heater R(1, 8). As a consequence, using such fluid jet head 400 in an inkjet printer will cause uneven ink droplets to be ejected and thus lead to undesirable print qualities.

To improve the uniformity of ink droplets ejected by fluid jet head, the invention utilizes the difference in voltage level between $1^{st}$ control voltage VG(1), which is input to gate of primary transistor Q(1, 1), and $8^{th}$ control voltage VG(8), which is input to gate of primary transistor Q(1, 8), in order to cause primary transistor equivalent resistance (1, 8) to be less than primary transistor equivalent resistance (1, 1), and thus causing the resistance as a whole, corresponding to current I(1, 1) and I(1, 8), to substantially equal. Current I(1, 1) and I(1, 8) are also substantially equal as a result. What to be achieved, ultimately, is so that the thermal energy heater generated by R(1, 1) can be equal to the thermal energy generated by R(1, 8).

The method of producing different voltage levels for $1^{st}$ control voltage VG(1) and $8^{th}$ control voltage VG(8) under present invention is illustrated below. Referring to FIG. 3, bias-voltage-selecting unit 302 has N column-selecting transistors CSQ and N current sources CS. Drains of the N column-selecting transistors CSQ receive a number of address-selecting signals respectively. N column-selecting transistors CSQ include a column-selecting transistor CSQ (1) and a column-selecting transistor CSQ(8). N current sources include a current source CS(1) and a current source CS(8). The address-selecting signals include a address-selecting signal VA(1) and a address-selecting signal VA(8). Current source CS(1) is coupled to source of column-selecting transistor CSQ(8), and current source CS(8) is coupled to source of column-selecting transistor CSQ(8). The gates of primary transistor CSQ(1) and column-selecting transistor CSQ(8) are electrically connected to each other, and both are for receiving control signal VAG'(1). $1^{st}$ control voltage VG(1) and $8^{th}$ control voltage VG(8) respectively correspond to the amount of current of current source CS(1) and CS(8). As mentioned above, N is, for example, equal to 19.

The current IA1 of current source CS(1) is greater than current IA8 of current source CS(8). When column-selecting transistor CSQ(1) is turned on and address-selecting signal VA(1) received by the drain of column-selecting transistor CSQ(1) is enabled, the current flowing through column-selecting transistor CSQ(1) is equal to IA1. $1^{st}$ control voltage VG1 outputted by source of column-selecting transistor CSQ(1) can be calculated according to MOSFET current equation: $I_d=(1/2)\mu_n C_{ox}(W/L)(V_{GS}-V_t)^2$ (Equation 1).

In equation 1, $I_d$ is the current flowing through drain, $\mu_n$ is the carrier mobility, $C_{ox}$ is the gate oxide capacitance, W and L are respectively the channel width and length, $V_{GS}$ is the voltage between gate and source, and $V_t$ is the threshold voltage.

When column-selecting transistor CSQ(8) is turned on and row-addressing signal (8) received by drain of column-selecting transistor CSQ(8) is enabled, then the current through column-selecting transistor CSQ(8) is IA8, and $8^{th}$ control voltage VG8 outputted by source of column-selecting transistor CSQ(8) can be calculated with equation 1. Since IA1 is greater than IA8, and under the condition that the channel width over length ratios of CSQ(1) and CSQ(8) are the same, it can be derived that the voltage between gate and source of CSQ(1) is greater than the voltage between gate and source of CSQ(8). Also, since the voltage level of the gate of both CSQ(1) and CSQ(8) are the same, it can be derived that the source voltage of CSQ(1) is smaller than the source voltage of CSQ(8).

Since $1^{st}$ control voltage VG1 is less than $8^{th}$ control voltage VG8, gate voltage of primary transistor Q(1, 1) is less than gate voltage of primary transistor Q(1, 8). And since the source of both Q(1, 1) and Q(1, 8) are grounded, the voltage between gate and source of Q(1, 1) is less than the voltage between gate and source of Q(1, 8). Using MOSFET equivalent resistance equation $r_{ds}=1/(\mu_n C_{ox}(W/L)(V_{GS}-V_t))$ (equation 2), it can be calculated that equivalent resistance of Q(1, 1) will be greater than equivalent resistance of Q(1, 8). The sum of resistance of heater R(1, 1), primary transistor equivalent resistance of Q(1, 1), and equivalent resistance of current path (1, 1) can therefore be substantially equal to the sum of resistance of heater R(1, 8), primary transistor equivalent resistance of Q(1, 8), and equivalent resistance of current path (1, 8), thereby causing current I(1, 1) to substantially equal to current I(1, 8). As a result, the thermal energy generated by heater R(1, 1) and heater R(1, 8) are substantially equal, and thus the orifices corresponding to heater R(1, 1) and R(1, 8) can eject evenly sized ink droplets. Consequently, the print quality of inkjet printer can be improved according to the object of invention.

Moreover, when primary transistor Q(1, 1) is turned off, the charge remaining on gate of Q(1, 1) is discharged through current source CS(1). Similarly, when primary transistor Q(1, 8) is turned off, the charge remaining on gate of Q(1, 8) is discharged through current source CS(8). Thus, the invention also can quickly discharge the charge remaining on gate of primary transistor to ground, thus, the error situations resulting from the continuing ejection of ink droplets from the corresponding nozzles in case of MOSFET turning off too late can be prevented.

Figure 6:
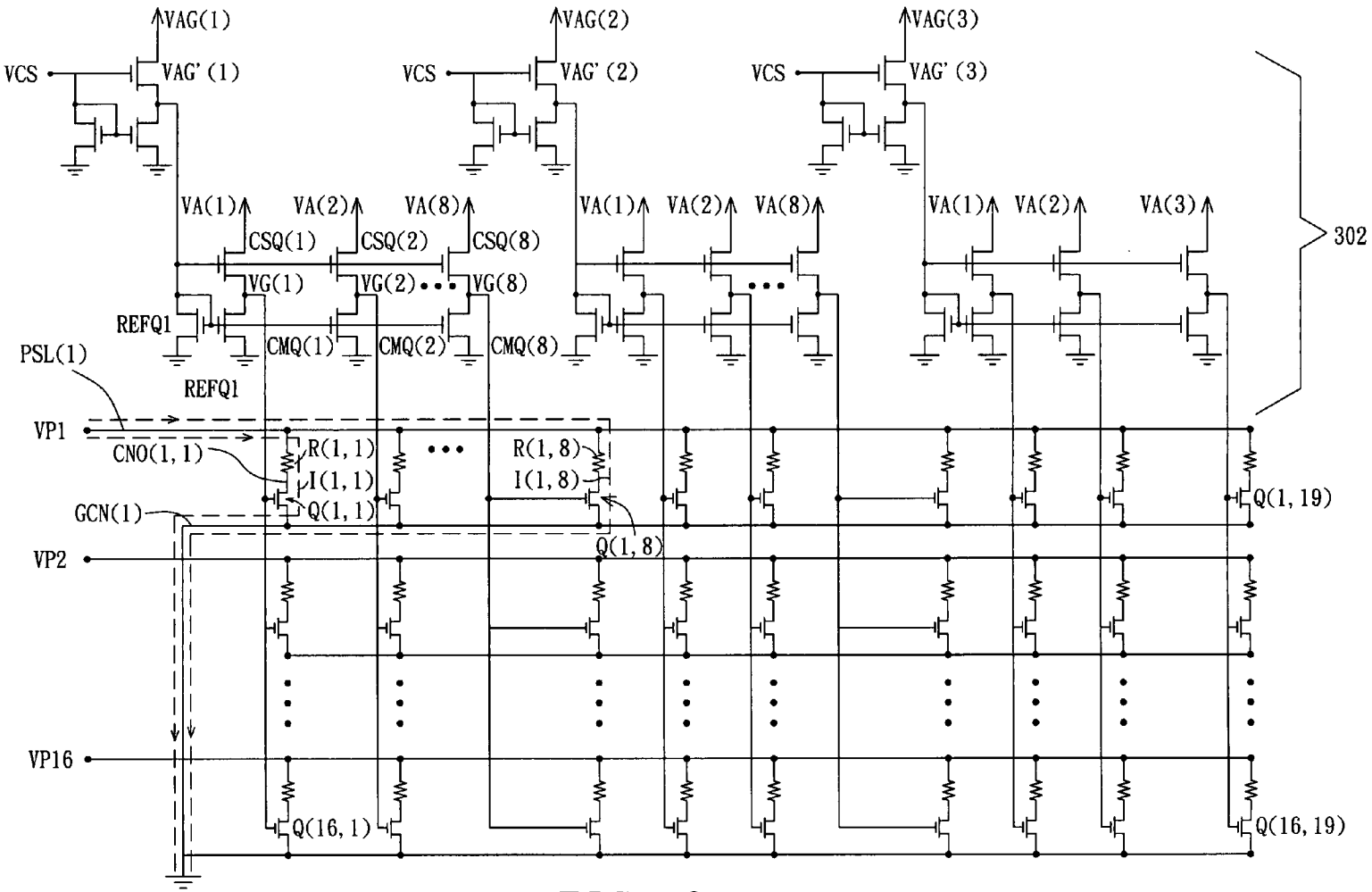
FIG. 6 is a circuit diagram of applying current mirrors in the circuit of FIG. 5.

Furthermore, the current source in FIG. 3 can be realized with current mirrors. FIG. 6 is a circuit diagram of applying current mirrors in the circuit of FIG. 5. Column-selecting transistors CSQ(1)~CSQ(8) is electrically connected to a multi-output current mirror. The multi-output current mirror includes a reference current mirror transistor REFQ1, current mirror transistors CMQ(1)–CMQ(8), and transistors CMQ(1) and CMQ(8) will be used for illustration. The drain and gate of reference current mirror transistor REFQ1 are electrically connected. The gate of CMQ(1) is coupled to gate of REFQ1. Drain of CMQ(1) is coupled to source of CSQ(1). Drain of CMQ(1) is coupled to gate of primary transistor Q(1, 1). Gate of CMQ(8) is coupled to gate of REFQ(1). Drain of CMQ(8) is coupled to source of CSQ(8), and drain of CMQ(8) is coupled to gate of primary transistor Q(1, 8).

When CSQ(1) is turned on and address-selecting signal VA(1) received by drain of CSQ(1) is enabled, the source of CSQ(1) outputs $1^{st}$ control voltage VG(1) to turn on primary transistor Q(1, 1). When CSQ(8) is turned on and address-selecting signal VA(8) received by drain of CSQ(8) is enabled, the source of CSQ(8) outputs $8^{th}$ control voltage VG(8) to turn on primary transistor Q(1, 8). VG(1) and VG(8) respectively correspond to the channel width over length ratio of CMQ(1) and CMQ(8).

When Q(1, 1) is turned off, the remaining charge on the gate of Q(1, 1) is discharged through current mirror transistor CMQ(1). Similarly, when Q(8) is turned off, the remaining charge on the gate of Q(1, 8) is discharged through current mirror transistor CMQ(8).

Preferably, the channel width over length ratios of the current mirror transistor CMQ(1) and current mirror transistor CMQ(8) should be different. As can be seen from equation 1, the channel width over length ratio of CMQ(1) and CMQ(8) are equivalent to the ratio of IA1 to IA8.

In addition, the gate of CSQ(1) is coupled to the drain of REFQ1, the gate of CSQ(8) is coupled to drain of REFQ1. When CSQ(1) is turned off, the charge remaining on gate of CSQ(1) is discharged through REFQ1. When CSQ(8) is turned off, charge remaining on gate of CSQ(8) is discharged through REFQ1. Hence, the operation speed of CSQ(1)–CSQ(8) can be increased.

In another aspect, bias-voltage-selecting unit 302 further includes S addressing electrodes, such as addressing electrode 502 of FIG. 5. Referring to FIG. 3, the addressing electrodes are for receiving S address-selecting signals VA(1)–VA(S). N column-selecting transistors are divided into P blocks. Every block of column-selecting transistors at most has S column-selecting transistors, and every block of column-selecting transistors is controlled by a block-selecting transistor BSQ. The S addressing electrodes are electrically connected to the P blocks of column-selecting transistors. When one of the block-selecting transistors is turned on, all the column-selecting transistors of the corresponding block of column-selecting transistors are turned on. The S address-selecting signals are outputted to the drains of the corresponding turned-on column-selecting transistors.

For illustration, as described above, N is equal to 19, S is equal to 8, and P is equal to 3. The 8 addressing electrodes are for receiving address-selecting signals VA(1)–VA(8). First block of column-selecting transistor is formed by column-selecting transistor CSQ(1)–CSQ(8), second block of column-selecting transistor is formed by CSQ(9)–CSQ(16), and third block of column-selecting transistor is formed by CSQ(17)–CSQ(19). The three blocks of column-selecting transistors are controlled by block-selecting transistors BSQ(1)–BSQ(3), respectively. The source of block-selecting transistor BSQ(1) outputs control voltage VAG'(1) to gates of all the column-selecting transistors of the first block of column-selecting transistors. And the source of BSQ(2) and the source of BSQ(3) respectively output control voltages VAG'(2) and VAG'(3) to the gates of all the column-selecting transistors of the second and third block of column-selecting transistors.

Figure 7:
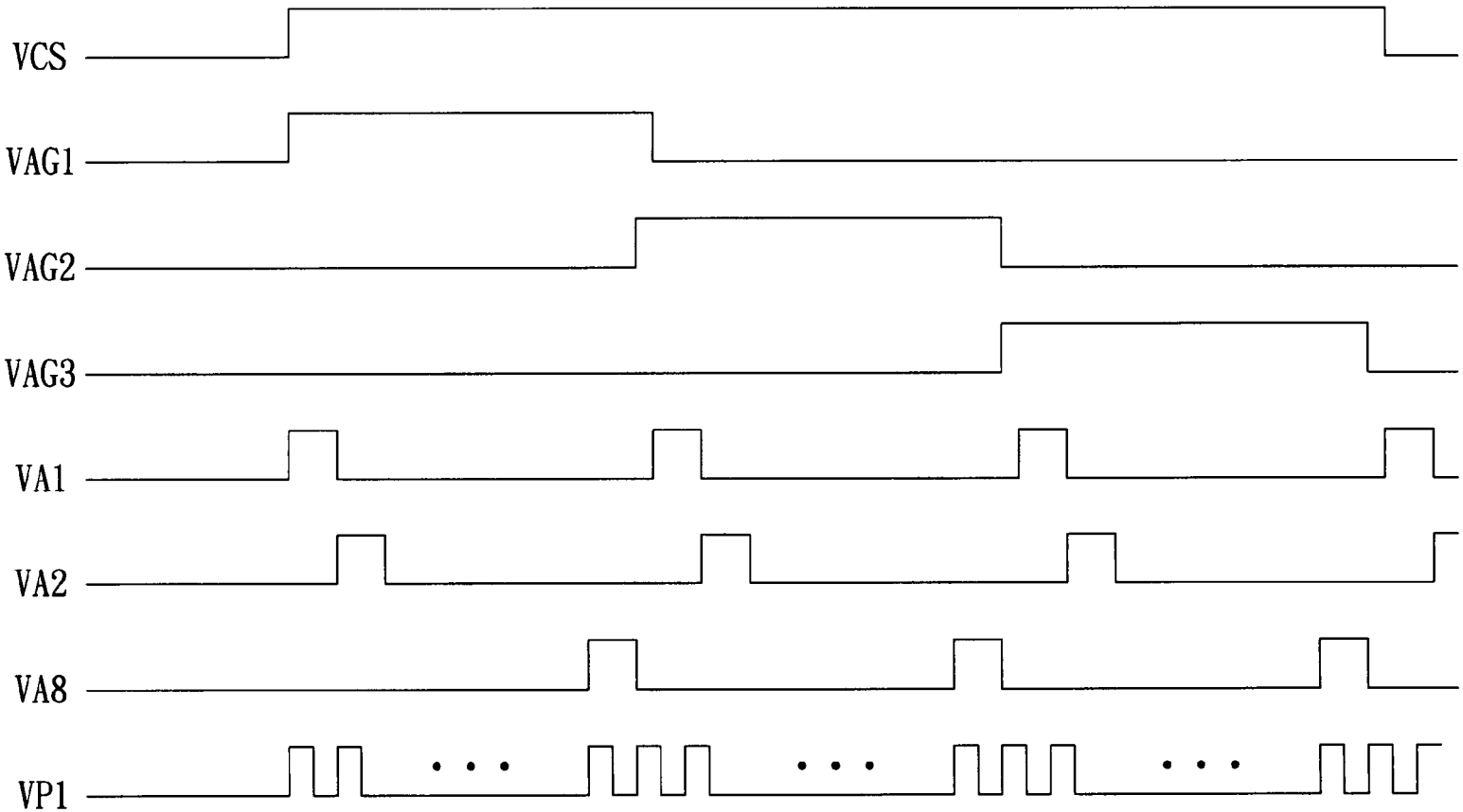
FIG. 7 shows waveforms of all signals used by the driving circuit of a heater of a fluid jet head.

The sources of block-selecting transistors BSQ(1)–BSQ(3) each connects to a current source, and the drains respectively connect to block-selecting signals VAG(1)–VAG(3). FIG. 7 shows waveforms of all signals used by the circuit for driving the heater of the fluid jet head. When control signal VCS is enabled, block-selecting transistors BSQ(1)–BSQ(3) are all turned on, and block-selecting signals VAG(1)–VAG(3) are respectively enabled during period T1, period T2 and period T3, thereby causing first block of column-selecting transistors CSQ(1)–CSQ(8), second block of column-selecting transistors CSQ(9)–CSQ(16), and third block of column-selecting transistors CSQ(17)–CSQ(19) to be turned on during period T1, T2 and T3, respectively. Thus, address-selecting signals VA(1)–VA(8) are outputted to first block, second block, and third block of column-selecting transistors during period T1, T2 and T3, respectively. That is, the 8 addressing electrodes are shared by the three blocks of column-selecting transistors; therefore, the invention has an advantage in that the number of addressing electrodes required are reduced.

Although the embodiment uses MOS transistors for illustration, yet the same effect can be achieved with bi-polar junction transistors (BJT) and junction filed effect transistors (JFET).

The fluid jet head with circuit for driving a heater set disclosed by the invention not only allows orifices to eject evenly sized ink droplets so as to improve print quality of an inkjet printer, and improves operation speed thereby preventing error conditions of fluid jet head from occurring, but also has the following advantages:

(1) Cost reduction, since only NMOS fabrication process is required to fabricate the driving circuit, thus the production costs can be reduced.

Figure 1:
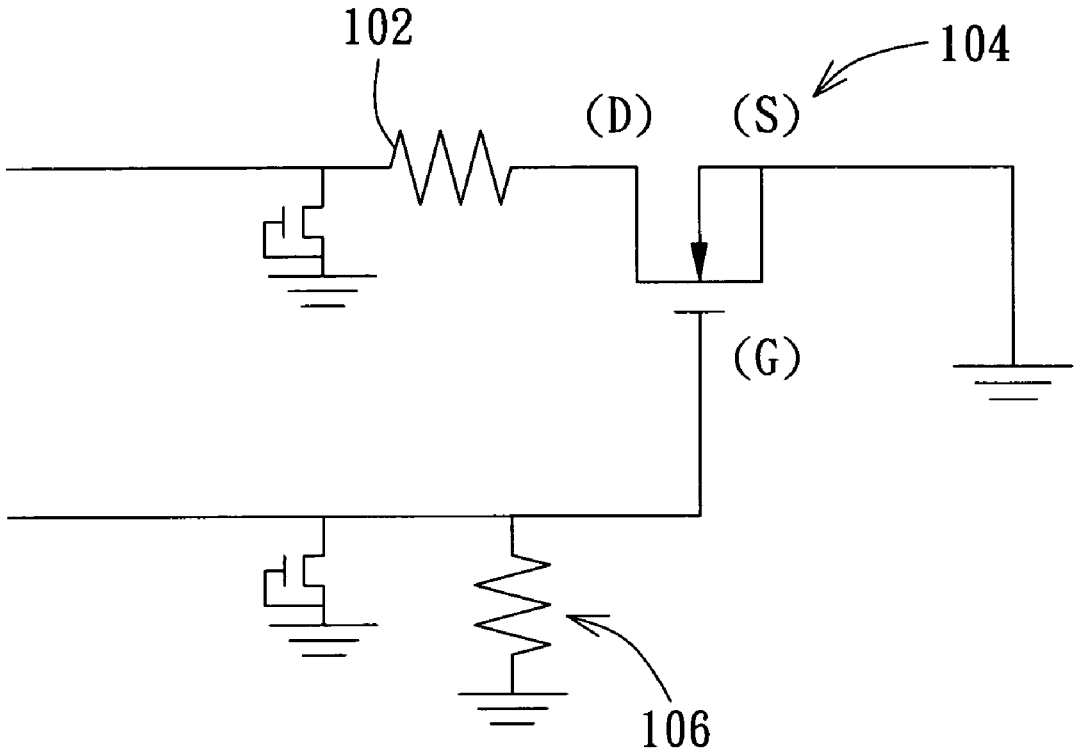
FIG. 1(PRIOR ART)
FIG. 1 shows a bubble jet head having discharging mechanism according to U.S. Pat. No. 5,604,519, "Inkjet Printhead Architecture for High Frequency Operation"
Figure 2:
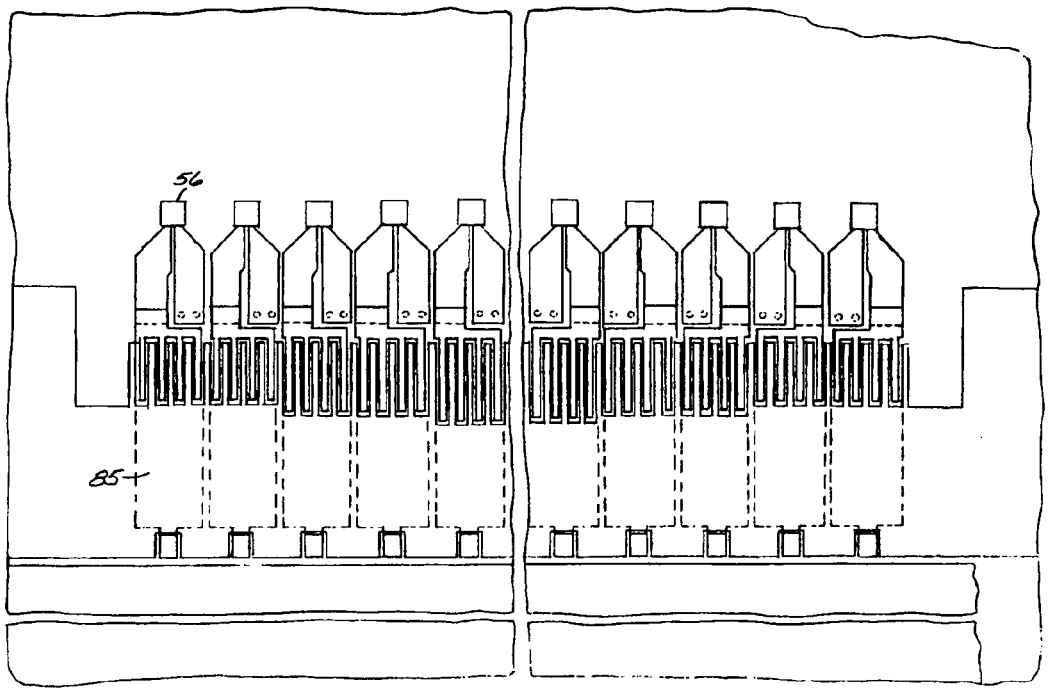
FIG. 2(PRIOR ART)
FIG. 2 shows a diagram illustrating an inkjet head capable of generating same thermal energy from every heater according to U.S. Pat. No. 6,412,917, "Energy Balanced Printhead Design".

(2) Reduction in area, since the invention uses active components (NMOS) to discharge the charge remaining on the gate of primary transistors, thus comparing to the snake-shaped fluid jet head design disclosed by U.S. Pat. No. 5,604,519 as shown in FIG. 1, the area can be relatively reduced.

(3) Better heat dissipating rate, since the snake-shaped resistor disclosed by U.S. Pat. No. 5,604,519 as shown in FIG. 11 forms direct contact with $SiO_2$, and does not come in direct contact with the substrate; thus, the resistor is that it is not very efficient in heat dissipation; however, the active component used under the invention for discharging the charge remaining in the gate of primary transistor forms direct contact with the substrate, and thus has better heat dissipation rate.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A circuit for driving a heater set, the heater set comprising a first heater and a second heater, the circuit comprising:

a plurality of current paths, each heater of the heater set being electrically connected to the corresponding current path, the current paths comprising a first current path and a second current path;

a bias-voltage-selecting unit, for outputting a first control voltage and a second control voltage;

a first primary transistor, electrically connected to the first heater, having a first primary transistor equivalent resistance when the first primary transistor being turned on by applying the first control voltage, and allowing a first current flow through the first heater, the first primary transistor, and the first current path; and a second primary transistor, electrically connected to the second heater, having a second primary transistor equivalent resistance when the second primary transistor being turned on by applying the second control voltage, and allowing a second current flow through the second heater, the second primary transistor, and the second current path, the resistance of the first current path being lower than the resistance of the second current path;

wherein the first primary transistor equivalent resistance is higher than the second primary transistor equivalent resistance by adjusting the first control voltage and the second control voltage, thereby causing the thermal energy generated by the first and second heaters to be substantially equal.

2. The circuit according to claim 1, wherein the bias-voltage-selecting unit comprises a first column-selecting transistor, a second column-selecting transistor, a first current source, and a second current source, the first column-selecting transistor and the second column-selecting transistor respectively receiving a first address-selecting signal and a second address-selecting signal, the first current source coupling to the source of the first column-selecting transistor, the second current source coupling to the source of the second column-selecting transistor, the gates of the first and the second column-selecting transistors electrically connecting to each other, the source of the first column-selecting transistor outputting the first control voltage when the first column-selecting transistor is turned on and the first address-selecting signal received by the drain of first column-selecting transistor is enabled, the source of the second column-selecting transistor outputting the second control voltage when the second column-selecting transistor is turned on and the second address-selecting signal received by the source of second column-selecting transistor is enabled, the first and second control voltages respectively corresponding to the amount of current of the first and second current sources.

3. The circuit according to claim 2, wherein the first primary transistor and the second primary transistor are both metal oxide semiconductors (MOS), the channel width-over-length ratios of the first and second primary transistors being substantially equal each other.

4. The circuit according to claim 2, wherein the resistances of the first heater and the second heater are substantially equal to each other, the equivalent resistance of the first current path being smaller than the equivalent resistance of the second current path, the amount of current of the first current source being greater than the amount of current of the second current source, the first control voltage being smaller than the second control voltage, the first primary transistor equivalent resistance being greater than the second primary transistor equivalent resistance, thereby causing the first current and the second current to substantially equal each other.

5. The circuit according to claim 1, wherein the bias-voltage-selecting unit further comprises:

a first column-selecting transistor and a second column-selecting transistor, for respectively receiving a first address-selecting signal and a second address-selecting signal; and a multi-output current mirror, comprising:

a reference current mirror transistor, the source and gate of the reference current mirror transistor being coupled to each other;

a first current mirror transistor, the gate of the first current mirror transistor coupling to the gate of the reference current mirror transistor, the drain of the first current mirror transistor coupling to the source of the first column-selecting transistor, the drain of the first current mirror transistor coupling to the gate of the first primary transistor; and a second current mirror transistor, the gate of the second current transistor coupling to the gate of the reference current mirror transistor, the drain of the second current mirror transistor coupling to the source of the second column-selecting transistor, the drain of the second current mirror transistor also coupling to the gate of the second primary transistor;

wherein the source of the first column-selecting transistor outputs the first control voltage to turn on the first primary transistor when the first column-selecting transistor is turned on and the first address-selecting signal received by the drain of the first column-selecting transistor is enabled;

wherein the source of the second column-selecting transistor outputs the second control voltage to turn on the second primary transistor when the second column-selecting transistor is turned on and the second address-selecting signal received by the drain of the second column-selecting transistor is enabled;

wherein the first and second control voltages respectively correspond to the channel width-over-length ratio of the first current mirror transistor and the channel width-over-length ratio of the second current mirror transistor;

wherein the residual charge remaining in the gate of the first primary transistor is discharged through the first current mirror transistor when the first primary transistor is turned off; and wherein the residual charge remaining in the gate of the second primary transistor is discharged through the second current transistor when the second primary transistor is turned off.

6. The circuit according to claim 5, wherein the gate of the first column-selecting transistor is coupled to the drain of the reference current mirror transistor, and the gate of the second column-selecting transistor is coupled to the drain of the reference current mirror transistor.

7. A fluid jet head, comprising:

a heater set, having a plurality of heaters arranged in an matrix of M rows by N columns, wherein the heater of the ith row and the jth column is heater (i, j), the heater of the ith row and the kth column is heater (i, k), wherein M, N, i, j, k are whole numbers, i is less than M or equal to M, j is less than N or equal to N, and j does not equal to k; and a driver circuit, comprising:

a plurality of current paths, each of the heaters corresponding and electrically connecting to one of the current paths, the current paths comprising a current path (i, j) and a current path (i, k);

a bias-voltage-selecting unit, for outputting N control voltages, comprising a $j^{th}$ control voltage and a $k^{th}$ control voltage, and M×N primary transistors, comprising:

a primary transistor (i, j), electrically connected to the heater (i, j), the resistance of the primary transistor (i, j) being equivalent to a primary transistor equivalent resistance (i, j) when the primary transistor (i, j) is turned on under the control of the $j^{th}$ control voltage, and when a current (i, j) is generated and flows through the heater (i, j), the primary transistor (i, j) and the current path (i, j); and a primary transistor (i, k), electrically connected to the heater (i, k), the resistance of the primary transistor (i, k) being equivalent to a primary transistor equivalent resistance (i, k) when the primary transistor (i, k) is turned on under the control of the $k^{th}$ control voltage, and when a current (i, k) is generated and flows through the heater (i, k), the primary transistor (i, k), and the current path (i, k);

wherein the primary transistor equivalent resistance (i, j) and the primary transistor equivalent resistance (i, k) respectively correspond to the $j^{th}$ control voltage and the $k^{th}$ control voltage, thereby causing the thermal energy generated by the heater (i, j) and heater (i, k) to substantially equal each other.

8. The fluid jet head according to claim 7, wherein each of the M×N primary transistors is a MOS transistor, the channel width-over-length ratios of the M×N primary transistors being substantially equal to one another.

9. The fluid jet head according to claim 7, wherein the bias-voltage-selecting unit comprises N column-selecting transistors and N current sources, the drains of the N column-selecting transistors respectively receiving a plurality of address-selecting signals, the N column-selecting transistors comprising a column-selecting transistor (j) and a column-selecting transistor (k), the N current sources comprising a current source (j) and a current source (k), the address-selecting signals comprising a address-selecting signal (j) and a address-selecting signal (k), the current source (j) coupling to the source of the column-selecting transistor (j), the current source (k) coupling to the source of the column-selecting transistor (k), the gates of the column-selecting transistor (j) and the column-selecting transistor (k) electrically connecting to each other;

wherein the source of the column-selecting transistor (j) outputs the $j^{th}$ control voltage when the column-selecting transistor (j) is turned on and the address-selecting signal (j) received by the drain of the column-selecting transistor (j) is enabled, wherein the source of the column-selecting transistor (k) outputs the $k^{th}$ control voltage when the column-selecting transistor (k) is turned on, and the address-selecting signal (k) received by the drain of the column-selecting transistor (k) is enabled, and wherein the $j^{th}$ control voltage and the $k^{th}$ control voltage respectively correspond to the amount of current of the current source (j) and the current source (k).

10. The fluid jet head according to claim 9, wherein the resistances of the heater (i, j) and the heater (i, k) are substantially equal to each other, the equivalent resistance of the current path (i, j) being smaller than the equivalent resistance of the current path (i, k), the amount of current of the current source (j) being greater than the amount of current of the current source (k) so that the $j^{th}$ control voltage is smaller than the $k^{th}$ control voltage, the primary transistor equivalent resistance (i, j) being greater than the primary transistor equivalent resistance (i, k) so that the current (i, j) is substantially equal to the current (i, k).

11. The fluid jet head according to claim 9, wherein the bias-voltage-selecting unit further comprises S addressing electrodes and P block-selecting transistors, the S addressing electrodes being used for receiving S address-selecting signals, the N column-selecting transistors dividing into P groups, each group of the column-selecting transistors at most comprising S column-selecting transistors, each group of the column-selecting transistors corresponding to one of the P block-selecting transistors, each group of the column-selecting transistors being controlled by the corresponding block-selecting transistor, the S addressing electrodes being electrically connected to the P groups of column-selecting transistors;

when one of the block-selecting transistor is turned on, all the column-selecting transistors corresponding to the turned on block-selecting transistor are also turned on, and the S address-selecting signals are outputted correspondingly to the drain of the turned on column-selecting transistors.

12. The fluid jet head according to claim 7, wherein the bias-voltage-selecting unit comprises:

N column-selecting transistors, comprising of a column-selecting transistor (j) and a column-selecting transistor (k) for respectively receiving an address-selecting signal (j) and an address-selecting signal (k); and a multi-output current mirror, comprising:

a reference current mirror transistor, the source and gate of the reference current mirror transistor coupling to each other;

a current mirror transistor (j), the gate of the current mirror transistor (j) coupling to the gate of the reference current mirror transistor, the drain of the current mirror transistor (j) coupling to the source of the column-selecting transistor (j), the drain of the current mirror transistor (j) also coupling to the gate of the primary transistor (j); and a current mirror transistor (k), the gate of the current transistor (k) coupling to the gate of the reference current mirror transistor, the drain of the current mirror transistor (k) coupling to the source of the column-selecting transistor (k), the drain of the current mirror transistor (k) also coupling to the gate of the primary transistor (k);

wherein the $j^{th}$ control voltage is outputted by the source of the column-selecting transistor (j) to turn on the primary transistor (j) when the column-selecting transistor (j) is turned on and the address-selecting signal (j) received by the drain of the column-selecting transistor (j) is enabled, and the source of the column-selecting transistor (k) outputs the $k^{th}$ control voltage to turn on the primary transistor (k) when the column-selecting transistor (k) is turned on and the address-selecting signal (k) received by the drain of the column-selecting transistor (k) is enabled, the $j^{th}$ and $k^{th}$ control voltages respectively corresponding to the channel width-over-length ratio of the current mirror transistor (j) and the channel width-over-length ratio of the current mirror transistor (k);

wherein the residual charge remaining in the gate of the primary transistor (j) discharges through the current mirror transistor (j) when the primary transistor (j) is turned off, and the residual charge remaining in the gate of the primary transistor (k) discharges through the current transistor (k) when the primary transistor (k) is turned off.

13. The fluid jet head according to claim 12, wherein the gate of the column-selecting transistor (j) is coupled to the drain of the reference current mirror transistor, and the gate of the column-selecting transistor (k) is coupled to the drain of the reference current mirror transistor.

14. The fluid jet head according to claim 7, wherein the fluid jet head further comprises a substrate, the substrate comprising M×N manifolds, M×N chambers, and M×N orifices, one end of each of the manifolds forming on a bottom surface of the substrate, each of the chambers being disposed above the corresponding manifolds and being connected with the corresponding manifold, the chambers being used for containing a fluid, the orifices arranging in a M×N matrix, each of the orifices being disposed above the corresponding chambers, one end of each of the orifices forming on a top surface of the substrate, the heaters are disposed on the side of the corresponding orifices, when one of the heaters generates thermal energy, the corresponding orifice generating an air bubble, thereby allowing the fluid in the corresponding chamber to be ejected.

15. The fluid jet head according to claim 14, wherein the fluid jet head is the ink jet head of an inkjet printer, the fluid jet head further comprising an ink cartridge, the manifolds being connected to the ink cartridge, and the fluid being an ink fluid.

16. The fluid jet head according to claim 14, wherein the fluid jet head further comprises a plurality of conducting lines, the conducting lines being disposed on the top surface above the manifolds, each of the conducting lines is used for electrically connecting the corresponding heater to the primary transistor, the material of the conducting line being selected from the group consisting of Aluminum, Gold, Bronze, Tungsten, Aluminum-Silicon-Bronze Alloy, Bronze-Aluminum Alloy, or the combination thereof.

17. A circuit for driving a heater set, the heater set comprising a first heater and a second heater, the circuit comprising:

a bias-voltage-selecting unit, for outputting a first control voltage and a second control voltage;

a first primary transistor, electrically connected in series to the first heater and a first current path, having a first primary transistor equivalent resistance when the first primary transistor being turned on by applying the first control voltage, and allowing a first current flow through the first heater, the first primary transistor, and the first current path; and a second primary transistor, electrically connected in series to the second heater and a second current path, having a second primary transistor equivalent resistance when the second primary transistor being turned on by applying the second control voltage, and allowing a second current flow through the second heater, the second primary transistor, and the second current path, the second current path being longer than the first current path;

wherein the first primary transistor equivalent resistance and the second primary transistor equivalent resistance are adjusted through controlling the first control voltage and the second control voltage, respectively, thereby changing the magnitudes of the first current and the second current paths and causing the thermal energy generated by the first and second heaters to be substantially equal.

18. The circuit according to claim 17, wherein the bias-voltage-selecting unit comprises a first column-selecting transistor, a second column-selecting transistor, a first current source, and a second current source, the first column-selecting transistor and the second column-selecting transistor respectively receiving a first address-selecting signal and a second address-selecting signal, the first current source coupling to the source of the first column-selecting transistor, the second current source coupling to the source of the second column-selecting transistor, the gates of the first and the second column-selecting transistors electrically connecting to each other, the source of the first column-selecting transistor outputting the first control voltage when the first column-selecting transistor is turned on and the first address-selecting signal received by the drain of first column-selecting transistor is enabled, the source of the second column-selecting transistor outputting the second control voltage when the second column-selecting transistor is turned on and the second address-selecting signal received by the source of second column-selecting transistor is enabled, the first and second control voltages respectively corresponding to the amount of current of the first and second current sources.

19. The circuit according to claim 18, wherein the resistances of the first heater and the second heater are substantially equal to each other, the first current path is shorter than the second current path, allowing the equivalent resistance of the first current path to be smaller than the equivalent resistance of the second current path, the voltage level of the first control voltage is lower than the voltage level of the second control voltage, allowing the first primary transistor equivalent resistance t be greater than the second primary transistor equivalent resistance, thereby causing the first current and the second current paths to substantially equal each other.

* * * * *